US007341637B2

(12) United States Patent
Kimura et al.

(10) Patent No.: US 7,341,637 B2
(45) Date of Patent: Mar. 11, 2008

(54) FERRITIC STAINLESS STEEL SHEET EXCELLENT IN PRESS FORMABILITY AND WORKABILITY AND METHOD FOR PRODUCTION THEREOF

(75) Inventors: Ken Kimura, Futtsu (JP); Masao Kikuchi, Tokyo (JP); Masayuki Tendo, Tokyo (JP); Junichi Hamada, Hikari (JP); Satoshi Akamatsu, Futtsu (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 236 days.

(21) Appl. No.: 10/467,120

(22) PCT Filed: Dec. 6, 2002

(86) PCT No.: PCT/JP02/12829

§ 371 (c)(1),
(2), (4) Date: Aug. 5, 2003

(87) PCT Pub. No.: WO03/048401

PCT Pub. Date: Jun. 12, 2003

(65) Prior Publication Data

US 2004/0055673 A1 Mar. 25, 2004

(30) Foreign Application Priority Data

Dec. 6, 2001 (JP) ..... 2001-373153

(51) Int. Cl.
*C22C 38/18* (2006.01)

(52) U.S. Cl. ..... 148/325; 420/34

(58) Field of Classification Search ..... 148/325; 420/34

See application file for complete search history.

(56) References Cited

U.S. PATENT DOCUMENTS 4,515,644 A 5/1985 Sawatani et al.
2002/0012602 A1* 1/2002 Takahashi et al. ..... 420/68

FOREIGN PATENT DOCUMENTS

| | | | |
|---|---|---|---|
| EP | 0841388 | A1 | 5/1998 |
| EP | 0924 313 | A1 | 6/1999 |
| EP | 0930375 | A1 | 7/1999 |
| EP | 1099485 | A2 | 5/2001 |
| JP | 62149385 | | 7/1987 |
| JP | 6-184632 | | 7/1994 |
| JP | 8-92652 | | 4/1996 |
| JP | 08260106 | | 10/1996 |
| JP | 09194938 | | 7/1997 |
| JP | 09316542 | | 12/1997 |
| JP | 10-46059 | | 2/1998 |
| JP | 10130786 | | 5/1998 |
| JP | 11-32502 | | 11/1999 |
| JP | 11-302739 | | 11/1999 |
| JP | 2000001757 | | 1/2000 |
| JP | 2000-256749 | | 9/2000 |
| JP | 2000-319584 | | 11/2000 |
| JP | 20000336462 | | 12/2000 |
| JP | 2001-149860 | | 6/2001 |
| JP | 2001254154 | | 9/2001 |

* cited by examiner

*Primary Examiner*—Sikyin Ip
(74) *Attorney, Agent, or Firm*—Kenyon & Kenyon LLP

(57) ABSTRACT

A ferritic stainless steel sheet excellent in press formability and operability, characterized by: containing appropriate amounts of C, N, Cr, Si, Mn, P, S, Al, Ti and V, with the balance consisting of Fe and unavoidable impurities; having a solid lubricating film or films on one or both of the surfaces; and having a ratio Z, defined as $Z=Z_1/Z_2$, of less than 0.5, a tensile strength of 450 MPa or less and an average r-value of 1.7 or more, wherein $Z_1$ is a friction coefficient of the surface of a solid lubricating film and $Z_2$ that of the surface of a reference material coated with neither a coating nor lubricating oil. In the ferritic stainless steel sheet, the amounts of Sol-Ti and Insol-V may be regulated to appropriate ranges, wherein Sol-Ti means the amount of Ti existing in the state of solid solution in steel and Insol-V means the amount of V existing in the state of precipitation in steel.

7 Claims, No Drawings

FERRITIC STAINLESS STEEL SHEET EXCELLENT IN PRESS FORMABILITY AND WORKABILITY AND METHOD FOR PRODUCTION THEREOF

TECHNICAL FIELD

The present invention relates to a ferritic stainless steel sheet excellent in press formability and, particularly, deep drawability and shape fixability, and operability, and a method for producing the steel sheet.

BACKGROUND ART

A ferritic stainless steel sheet is used mostly in the form of press-formed members for kitchen facilities, electric appliances and the like. However, as a ferritic stainless steel sheet is significantly inferior in formability to a SUS304 steel sheet, a typical austenitic stainless steel sheet, it is prone to problems such as cracking in press forming work.

In addition, compared with an ultra-low-carbon steel sheet, a ferritic stainless steel sheet has problems of cracking during press forming caused by its inferior deep drawability and poor shape fixability caused by its higher hardness.

Though there has been strong a need for replacing members of austenitic stainless steel, from the viewpoint of material costs, and members of ultra-low-carbon steel, from the viewpoint of corrosion protection and appearance, with members of ferritic stainless steel, in the event of employing ferritic stainless steel, the poor press formability thereof has been a major obstacle.

In order to solve the problem, various methods have been studied to improve the formability of a ferritic stainless steel sheet and a method wherein the contents of C and N are lowered and elements such as Ti and Nb are added is publicly known as one solution. Despite such improvements, however, formability of a ferritic stainless steel enough to replace a member of austenitic stainless steel or ultra-low-carbon steel with a member of ferritic stainless steel has not been realized.

It is a normal practice in the forming of a stainless steel sheet to apply lubricating oil such as machine oil to the sheet for preventing cracking and die galling during press forming. However, as this requires a cleaning process for removing the lubricating oil after the press forming, there has been a problem of poor operability. In addition, though it is desirable for lubricating oil to have a high viscosity for improving formability, there has been a problem in that the higher the viscosity is, the more often oil remains after cleaning.

As stated above, the problems related to the formability of a ferritic stainless steel sheet have not been solved satisfactorily and, even when the forming thereof is possible, the application and removal of lubricating oil have been required and thus considerable operability has been sacrificed.

As is shown on page 254 of the Press Forming Handbook—In View of Forming Difficulty, the Second Edition, edited by the Thin Steel Sheet Forming Technology Workshop, a lubricated steel sheet having been coated with solid lubricating films beforehand and not requiring lubricating oil has been developed recently. However, simply applying solid lubricating films to a presently existing ferritic stainless steel sheet has been insufficient to realize good formability comparable to that of an austenitic stainless or ultra-low-carbon steel sheet.

As examples of the latest technologies, stainless steel sheets wherein the elongation after fracture and the Lankford values (hereinafter referred to as an r-value) thereof are raised, acrylic or urethane resin is applied to the surfaces, and by so doing improved material properties and the function of lubricating films are combined together, are disclosed in Japanese Unexamined Patent Publication Nos. 2002-60972 and 2002-60973.

By such a method, however, though a limiting drawing ratio (hereinafter referred to as an LDR) measured through cylindrical cup deep-drawing test has been improved, formability has been insufficient for applying the method to those components that require not only deep drawability but also punch stretchability. In addition, by the method, spring back occurs after press forming and thus there has been a problem with shape fixability as well.

SUMMARY OF THE INVENTION

The object of the present invention is, in view of the above situation, to provide: a ferritic stainless steel sheet excellent in press formability to the extent of being able to replace an austenitic stainless or ultra-low-carbon steel sheet, capable of eliminating oiling and degreasing accompanying press forming, and thus excellent in operability as well; and a method for producing the steel sheet.

The present invention includes a ferritic stainless steel sheet wherein: the upper limit of tensile strength is regulated and an average r-value is improved for suppressing the deterioration of the shape fixability of the steel sheet; and the state of precipitation and solid solution in steel is optimized and solid lubricating films are applied to the surfaces for securing a very excellent deep drawability. The present invention has been established on the basis of identifying the production conditions of such a ferritic stainless steel sheet.

The present inventors, using various ferritic stainless steels, examined the formability of ferritic stainless steel sheets in the cases of changing chemical compositions, r-values and the states of precipitation and solid solution and further applying solid lubricating films having different properties. An r-value and a tensile strength were measured through tensile tests in conformity with JIS (Japanese Industrial Standards) Z 2254 and Z 2241, respectively. An amount of precipitates was determined by quantitatively analyzing the electrolytically extracted residues of a steel. An amount of a solid-solute element was determined by subtracting the relevant precipitate amount obtained as above from the total addition amount of the relevant element.

Formability was evaluated through a cylindrical cup deep-drawing test for measuring deep drawability, an Erichsen test for measuring punch stretchability, a rectangular cup forming test for measuring both deep drawability and punch stretchability, and a hat-shape bending test for measuring shape fixability.

The Erichsen test was carried out in conformity with JIS Z 2247. The results of the cylindrical cup deep-drawing test were evaluated in conformity with the TZP test specified in pages 468-469 of the Press Forming Handbook—In View of Forming Difficulty, the Second Edition, edited by the Thin Steel Sheet Forming Technology Workshop.

In the rectangular cup forming test, a specimen was subjected to deep drawing by using a punch and a die both having a rectangular section, and the formability was evaluated in terms of the drawing depth at the time when the specimen cracked.

The hat-shape bending test was carried out in conformity with the test method specified in page 482 of the Press Forming Handbook—In View of Forming Difficulty, the Second Edition, and shape fixability was evaluated in terms of the deviation of the angle of the portion bent by the punch shoulder from a right angle.

A friction coefficient was evaluated through Bowden test. The Bowden test is a point contact type friction test that makes use of reciprocating sliding of a steel ball and a steel sheet as described in pages 66-67 of the Plastic Forming Work Technology Series No. 3, Process Tribology—Lubrication in Metal Forming edited by the Japan Society for Technology of Plasticity.

As a result of the tests and examinations, it has been clarified that a ferritic stainless steel sheet has formability equal to or better than that of a steel sheet of austenitic stainless steel SUS304 or Ti-added ultra-low-carbon steel when some of the following conditions (A) to (F) are combined:

(A) The amount of P as a steel component is controlled to 0.02% or less.

(B) An average r-value is controlled to 1.7 or more.

(C) A tensile strength is controlled to 450 MPa or less.

(D) V is added by 0.1% or so, and the amount of V precipitating in the form of carbonitride and the like is controlled to 0.01% or less or, in other words, a certain amount of V existing in the state of solid solution is secured.

(E) The amount of Ti existing in the form of solid solution in a steel is controlled to 0.16% or less.

(F) A solid lubricating film that as has a friction coefficient less than 50% of that of a reference material is applied. More specifically, the ratio $Z_1/Z_2$ is less than 0.5, wherein $Z_1$ is the friction coefficient of a steel sheet coated with a solid lubricating film and $Z_2$ the friction coefficient of a reference material that is a steel sheet having a surface roughness Ra in the range from 0.05 to 0.07 μm and being coated with neither a solid lubricating film nor lubricating oil.

The gist of the present invention, which has been established on the basis of the above finding, is as follows:

(1) A ferritic stainless steel sheet excellent in press formability and operability, characterized by: containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%, and
V: 0.03 to 0.12%, with the balance consisting of Fe and unavoidable impurities; having a solid lubricating film or films on one or both of the surfaces; and having a ratio Z, defined as $Z=Z_1/Z_2$, of less than 0.5, a tensile strength of 450 MPa or less and an average r-value of 1.7 or more, wherein $Z_1$ is a friction coefficient of the surface of a solid lubricating film and $Z_2$ that of the surface of a reference material having a surface roughness Ra in the range from 0.05 to 0.07 μm and being coated with neither a coating nor lubricating oil.

(2) A ferritic stainless steel sheet excellent in press formability and operability, characterized by: containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
Sol-Ti: 0.03 to 0.16%,
V: 0.03 to 0.12%, and
Insol-V: less than 0.01%, with the balance consisting of Fe and unavoidable impurities, wherein Sol-Ti means the amount of Ti existing in the state of solid solution in steel and Insol-V means the amount of V existing in the state of precipitation in steel; having a solid lubricating film or films on one or both of the surfaces; and having a ratio Z, defined as $Z=Z_1/Z_2$, of less than 0.5, wherein $Z_1$ is a friction coefficient of the surface of a solid lubricating film and $Z_2$ that of the surface of a reference material having a surface roughness Ra in the range from 0.05 to 0.07 μm and being coated with neither a coating nor lubricating oil.

(3) A ferritic stainless steel sheet excellent in press formability and operability according to the item (2), characterized by having a tensile strength of 450 MPa or less and an average r-value of 1.7 or more.

(4) A ferritic stainless steel sheet excellent in press formability and operability according to any one of the items (1) to (3), characterized by containing, in mass, 0.0001 to 0.01% Mg.

(5) A ferritic stainless steel sheet excellent in press formability and operability according to any one of the items (1) to (4), characterized by containing, in mass, 0.0005 to 0.005% B.

(6) A ferritic stainless steel sheet excellent in press formability and operability according to any one of the items (1) to (5), characterized by containing, in mass, 0.1 to 3% Mo.

(7) A member of an electric appliance characterized by being made of a ferritic stainless steel sheet excellent in press formability and operability according to any one of the items (1) to (6).

(8) A method for producing a ferritic stainless steel sheet excellent in press formability and operability according to any one of the items (1) and (4) to (6), characterized by: heating a ferritic stainless steel slab, containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
V: 0.03 to 0.12%, and, as required, one or more of Mg: 0.0001 to 0.01%,
B: 0.0005 to 0.005%, and
Mo: 0.1 to 3%, with the balance consisting of Fe and unavoidable impurities, to a temperature in the range from 1,050° C. to 1,250° C.; subjecting the heated slab to hot rolling at a total reduction ratio of 95% or more, a finish rolling temperature of 750° C. to 950° C. and a coiling temperature of 500° C. to 800° C.; then, after annealing the hot-rolled steel sheet or without annealing it, subjecting it to cold rolling at a total reduction ratio of 60 to 95%; heating the cold-rolled steel sheet to a temperature in the range from 800° C. to 950° C.; holding it at the temperature for 0 to 30 sec.; thereafter cooling it; and then coating it with a solid lubricant.

(9) A method for producing a ferritic stainless steel sheet excellent in press formability and operability according to any one of the items (2) and (4) to (6), characterized by: heating a ferritic stainless steel slab, containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
V: 0.03 to 0.12%, and, as required, one or more of
Mg: 0.0001 to 0.01%,
B: 0.0005 to 0.005%, and
Mo: 0.1 to 3%, with the balance consisting of Fe and unavoidable impurities, to a temperature in the range from 1,050° C. to 1,250° C.; subjecting the heated slab to hot rolling at a finish rolling temperature of 750° C. to 950° C. and a coiling temperature of 500° C. to 800° C.; then, after annealing the hot-rolled steel sheet or without annealing it, subjecting it to cold rolling; heating the cold-rolled steel sheet to a temperature in the range from 800° C. to 950° C.; holding it at the temperature for 0 to 30 sec.; thereafter cooling it to 500° C. or lower at a cooling rate of 10° C./sec. or more; and then coating it with a solid lubricant.

(10) A method for producing a ferritic stainless steel sheet excellent in press formability and operability according to any one of the items (3) to (6), characterized by: heating a ferritic stainless steel slab, containing, in mass, C: 0.001 to 0.01%,
N: 001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
V: 0.03 to 0.12%, and, as required, one or more of
Mg: 0.0001 to 0.01%,
B: 0.0005 to 0.005%, and
Mo: 0.1 to 3%, with the balance consisting of Fe and unavoidable impurities, to a temperature in the range from 1,050° C. to 1,250° C.; subjecting the heated slab to hot rolling at a total reduction ratio of 95% or more, a finish rolling temperature of 750° C. to 950° C. and a coiling temperature of 500° C. to 800° C.; then, after annealing the hot-rolled steel sheet or without annealing it, subjecting it to cold rolling at a total reduction ratio of 60 to 95%; heating the cold-rolled steel sheet to a temperature in the range from 800° C. to 950° C.; holding it at the temperature for 0 to 30 sec.; thereafter cooling it to 500° C. or lower at a cooling rate of 10° C./sec. or more; and then coating it with a solid lubricant.

(11) A method for producing a ferritic stainless steel sheet excellent in press formability and operability according to any one of the items (8) to (10), characterized by subjecting the cold-rolled steel sheet to temper rolling at a reduction ratio of 0.3 to 1.5% after heating and cooling it but before coating it with a solid lubricant.

THE MOST PREFERRED EMBODIMENT

The essence of the present invention is, on the premise that a solid lubricating film is applied to a steel sheet, to lower the tensile strength of the steel sheet and increase the average r-value thereof for improving the workability, especially the shape fixability, of the steel sheet, and also to optimize the state of precipitation and solid solution in the steel by adequately controlling the steel components and production conditions for further improving the deep drawability of the steel sheet. The present invention is explained hereafter in detail.

In the first place, the reasons are explained for restricting steel components in the present invention. Note that, in the descriptions below, percentage figures are in mass.

C and N: When either C or N is added abundantly, formability deteriorates and also the amount of Ti required for fixing them increases. For those reasons, the upper limits of contents of C and N are set at 0.01% and 0.015%, respectively. The lower limit is set at 0.001% for both in consideration of steel refining costs.

Cr: Cr is an element necessary for securing corrosion resistance, which constitutes the most fundamental property of stainless steel. When Cr is added by 10% or more, corrosion resistance significantly improves. For this reason, the lower limit of a Cr content is set at 10%. When Cr is added by more than 19%, however, formability deteriorates. For this reason, the upper limit of a Cr content is set at 19%.

Si: Si is an element used as a deoxidizing agent. When an Si content is more than 0.8%, formability significantly deteriorates. For this reason, the upper limit of an Si content is set at 0.8%. Si is unavoidably included in steel by 0.01% and, for this reason, the lower limit of an Si content is set at 0.01% in consideration of steel refining costs.

Mn: When Mn is added abundantly, formability deteriorates. For this reason, the upper limit of an Mn content is set at 0.5%. The lower limit of an Mn content is set at 0.01% in consideration of steel refining costs.

P: P is a particularly important constituent element for the present invention. In the case where a solid lubricating film is applied, formability significantly improves by controlling the content of P to 0.02% or less. For this reason, the upper limit of a P content is set at 0.02%. When a P content is less than 0.01%, however, steel refining costs increase significantly. For this reason, the lower limit of a P content is set at 0.01%.

P is included in raw materials such as ferrochromium and, as a result, a 10-19% Cr steel usually contains P by 0.02 to 0.03%. Therefore, it is necessary to employ an intensive dephosphorization treatment or adequately select raw materials to satisfy the above upper limit.

S: When S is added abundantly, corrosion resistance deteriorates. For this reason, an S content is limited to less than 0.01%.

Al: Al is used as a deoxidizing agent, but a large addition amount of Al deteriorates formability. For this reason, the upper limit of an Al content is set at 0.1%. The lower limit of an Al content is set at 0.005% as the least required amount for deoxidizing.

Ti: Ti is an element that combines with C, N, etc. to form precipitates and, by so doing, improves formability. Since it is necessary to add Ti by 0.05% or more for obtaining the formability improvement effect, the lower limit of a Ti content is set at 0.05%. When Ti is added by more than 0.25%, formability may deteriorate, in some cases, on the contrary. For this reason, the upper limit of a Ti content is set at 0.25%.

V: V is another particularly important constituent element for the present invention. The lower limit of a V content is set at 0.03% as the least amount required for obtaining a formability improvement effect in the case where a solid lubricating film is applied. When V is added by more than 0.12%, however, no further formability improvement effect is obtained and, what is worse, raw material costs increase. For those reasons, the upper limit of a V content is set at 0.12%.

V is included in ferrochromium raw material and, as a result, V is unavoidably included in steel by about 0.02% in some cases. Since the V coming from raw material has the same effect as the V added deliberately, it is necessary to control the total V content to the range specified above.

In a steel sheet according to any one of the aforementioned items (2) to (6), the amounts of Sol-Ti and Insol-V are regulated as explained below for the purpose of significantly enhancing deep drawability.

Sol-Ti: With regard to Ti, it is further necessary to control the amount of Ti in the state of solid solution. Sol-Ti refers to the amount of Ti existing in the state of solid solution in a steel. When the amount of solid-solute Ti exceeds 0.16%, the formability of a steel sheet coated with a solid lubricating film deteriorates. For this reason, the upper limit of an Sol-Ti amount is set at 0.16%. On the other hand, for inhibiting the intergranular corrosion of a weld, it is necessary to secure a solid-solute Ti amount of 0.03% or more. For this reason, the lower limit of a Sol-Ti amount is set at 0.03%. An amount of solid-solute Ti may be obtained by quantitatively analyzing the electrolytically extracted residues of a steel, thus determining the amount of Ti existing in the form of precipitate, and subtracting the Ti precipitate amount from the total addition amount of Ti.

Insol-V: In the case of V, it is necessary to regulate the amount of V precipitating as the precipitates of V. Insol-V refers to all V amounts existing in the form of precipitates in a steel. When the amount of V precipitates is 0.01% or more, the formability of a steel sheet coated with a solid lubricating film deteriorates. For this reason, the upper limit of an Insol-V amount is set at less than 0.01%. An amount of V precipitates may be obtained by quantitatively analyzing the electrolytically extracted residues of a steel.

Hereafter, the elements to be optionally added to a steel according to the present invention are explained.

Mg: Mg is an element that makes the structure of a weld fine and thus improves the formability of the weld. For this reason, Mg may be added as an optional element when the forming of a weld is required. The effect of improving the formability of a weld shows up with an Mg addition amount of 0.0001% or more. For this reason, the lower limit of an Mg content is set at 0.0001%. The upper limit of an Mg content is set at 0.01% in consideration of raw material costs.

B: B is an element that improves workability at secondary working, and, therefore, B may be added in the case where a plurality of forming processes are applied. The effect of improving workability at secondary working shows up with a B addition amount of 0.0005% or more. When B is added in excess of 0.005%, however, toughness may deteriorate in some cases. For this reason, the upper limit of a B content is set at 0.005%.

Mo: Mo is an element that improves corrosion resistance, and, therefore, Mo may be added in the case where a steel material is subjected to a severely corrosive environment. The effect of improving corrosion resistance shows up with an Mo addition amount of 0.1% or more, and, therefore, the lower limit of an Mo content is set at 0.1%. When Mo is added in excess of 3%, on the other hand, raw material costs increase significantly and, in addition, formability deteriorates. For those reasons, the upper limit of an Mo content is set at 3%.

In a steel sheet according to any one of the aforementioned items (1) and (3) to (6), the average r-value is determined to be 1.7 or more and the tensile strength to be 450 MPa or less. By the combination of the two determinations, press formability superior to that of a conventional steel sheet is secured and shape fixability is improved remarkably. When an average r-value is less than 1.7 or a tensile strength is more than 450 MPa, spring back after press forming may increase and a good product shape may not be obtained stably, in some cases.

No upper limit of an average r-value is specified but the maximum value obtainable without incurring any significant cost increase in existing production facilities is 3.0. No lower limit of a tensile strength is specified either but the lowest tensile strength of a stainless steel containing a large amount of Cr is usually 330 MPa. An r-value may be measured in conformity with JIS Z 2254, and a tensile strength in conformity with JIS Z 2241.

As stated before, formability constitutes a problem with a ferritic stainless steel sheet more often than with an austenitic stainless steel sheet. In this connection, the friction coefficient of a ferritic stainless steel sheet surface constitutes one of the factors governing the formability of the steel sheet at press forming. This problem has conventionally been coped with by applying oil as described earlier. However, since the oil has to be removed afterward, the application of oil deteriorates operability.

In view of this, the present inventors focused attention on the possibility that cleaning for removing oil might not be required if a steel sheet was pre-coated with a solid lubricating film capable of sufficiently reducing the friction coefficient of a surface and used without removing the film.

The feature to be fulfilled by a solid lubricating film is that a ratio Z defined as $Z=Z_1/Z_2$ is limited to less than 0.5, wherein $Z_1$ is the friction coefficient of the surface of a solid lubricating film and $Z_2$ is that of the surface of a reference material having a surface roughness Ra conditioned in the range from 0.05 to 0.07 μm and being coated with neither a coating nor lubricating oil.

That is, it is necessary to control a ratio Z to less than 0.5, or otherwise good formability is not realized. It is desirable that the ratio Z is as small as possible. However, a ratio Z of 0.1 or less may often result in a cost disadvantage. For that reason, a ratio Z of about 0.3 is said to be a desirable level from the viewpoint of the balance between formability and cost.

The reason why Z is defined as a ratio of a friction coefficient of the surface of a solid lubricating film to that of the surface of a reference material in the present invention is that a friction coefficient measured by a test method such as Bowden test, wherein the surface of a specimen contacts a tool, may fluctuate in accordance with environmental conditions (temperature, moisture, etc.) and the conditions of a test apparatus. Whereas the absolute value of a friction coefficient fluctuates in accordance with measurement conditions, a relative ratio of friction coefficients does not change significantly as far as they are measured under the same conditions.

Therefore, the present inventors reasoned that the friction coefficient fluctuation caused by measurement conditions could be minimized if a friction coefficient of the surface of a solid lubricating film and that of the surface of a reference material having a surface roughness Ra in the range from 0.05 to 0.07 μm and being coated with neither a coating nor lubricating oil were measured under the same conditions and the ratio between the two friction coefficients was used.

A friction coefficient can be measured by aforementioned Bowden test for example. Otherwise, a friction coefficient may be obtained by taking the steps of: pulling a specimen and measuring the pulling force while pressing a tool onto the specimen under a prescribed load; repeating the above procedures twice or more changing the pressing load; plotting the pulling forces against the pressing loads; and defining the gradient of the curve thus plotted as the friction coefficient.

In the present invention, the value of Z is not affected by the contact area of a tool and a specimen since it is defined as the ratio between the friction coefficients of a specimen and a reference material. Therefore, any tool is acceptable as long as the portion of a tool contacting with a specimen has a spherical shape, and the material and the size of a tool are not specified.

Note that a surface roughness Ra is an arithmetic average roughness specified in JIS B 0601 as a parameter for expressing surface roughness. The repeatability of the measured values of the surface roughness Ra of a metal surface is far better than that of the measured friction coefficients.

Note also that it is necessary to limit the surface roughness of a reference material in a narrow range because a friction coefficient is significantly affected by a surface roughness.

Further, when a surface roughness is large, a measured friction coefficient fluctuates more. Therefore, the surface roughness Ra of a reference material is limited in the range from 0.05 to 0.07 μm.

Furthermore, any material is acceptable as a reference material as long as the material is a stainless steel sheet since the influence of a material on a friction coefficient is insignificant. However, a preferable reference material is a ferritic stainless steel sheet and the best reference material is a ferritic stainless steel sheet having chemical components in the ranges specified in the present invention.

A solid lubricating film is defined as a film of a lubricant that is in a solid state at room temperature. Either an organic or inorganic film may be used as a solid lubricating film as far as a value of Z satisfies the aforementioned condition. Urethane, acrylic, olefin, polyester, epoxy resins and the like are counted as organic lubricants, and silicate, titanium oxide, phosphate, chromate, zirconate films and the like are counted as inorganic lubricants.

In the case of an organic lubricant, a suitable film thickness is in the range from 0.5 to 10 μm and it is desirable to add wax such as that of a fluoride or polyethylene system by 0.5 to 30% of the solid content of resin. In the case of an inorganic lubricant, a suitable deposition amount is 10 to 500 $mg/m^2$.

A removable type coating film, which can be washed away by degreasing, may be used as a solid lubricating film. However, a ferritic stainless steel sheet is sometimes used without paint coating and, in such a case, a post-treatment such as degreasing or chemical treatment is not required and therefore a non-removable type solid lubricating film, which need not be removed from a final product, is suitable.

Further, when a ferritic stainless steel sheet is used for a product requiring compatibility with good appearance and design, it is desirable to use a clear solid lubricating film. Furthermore, as the present invention makes it unnecessary to apply a meticulous surface finishing for the purpose of reducing a friction coefficient, a substantial cost reduction is expected for some applications along with improvement in operability.

Any method may be employed for applying a solid lubricating film in the present invention. For example, brush coating or spray coating may be employed, or otherwise, roll coating, curtain coating or the like, which is widely used for applying an organic film, may also be employed. Since an important issue of the present invention is the friction coefficient of the surface of a solid lubricating film, due consideration must be paid not only to a coating method but also to a method of drying and baking.

In order for a solid lubricating film according to the present invention to have additional functions such as corrosion resistance, stain resistance, compatibility with good appearance and design, and the like, in combination, an anticorrosive pigment, a metal powder, and the like, may be added. In such a case too, the friction coefficient of the surface of a solid lubricating film must satisfy the requirement of the present invention. In that sense, a multiple-layered coating film having the outermost layer satisfying the requirement of the present invention may also be used.

A ferritic stainless steel sheet according to the present invention is produced through the processes of melting, casting, hot rolling, cold rolling and annealing and, thereafter, is coated with a solid lubricating film. The steel sheet may be subjected to another annealing process after the hot rolling. When annealing is applied to a hot-rolled steel sheet, it is desirable to use a continuous annealing line for the annealing in consideration of production efficiency. The annealing of a hot-rolled steel sheet may be carried out under normal conditions and no specific conditions are regulated in the present invention.

Further, from the viewpoint of securing good surface properties, a steel sheet may be subjected to annealing during the course of cold rolling. In this case, the annealing may be carried out under normal conditions since the annealing does not adversely affect formability. Furthermore, it is desirable to subject a hot-rolled steel sheet to pickling. In this case, normal conditions may be applied for pickling liquor, processing time and other operation parameters. After cold rolling and annealing, a steel sheet may be subjected to temper rolling.

When a heating temperature in a hot rolling process is lower than 1,050° C., the re-solution of precipitates does not occur sufficiently in a slab. However, when it is higher than 1,250° C., crystal grains coarsen and hot workability deteriorates. For those reasons, a heating temperature in a hot rolling process must be in the range from 1,050° C. to 1,250° C.

For further suppressing the coarsening of crystal grains, the most suitable upper limit of the heating temperature is 1,200° C. It is preferable to measure a heating temperature by attaching thermocouples to a slab. Here, when a slab is held in a reheating furnace for one hour or longer, the temperature of furnace atmosphere may be regarded as the heating temperature of the slab.

When a finish rolling temperature is lower than 750° C., rolling loads increase, and cracks and surface defects are likely to occur to a hot-rolled steel sheet. When a finish rolling temperature exceeds 950° C., on the other hand, work strain imposed during hot rolling is relieved and recrystallization hardly occurs in a coiling process or an annealing process after hot rolling. Therefore, a finish rolling temperature must be in the range from 750° C. to 950° C.

When a coiling temperature in a hot rolling process is lower than 500° C., the state of precipitates may change and formability may deteriorate in some cases. When it is higher than 800° C., on the other hand, dense oxides form on the surfaces of a steel sheet and a burden in the subsequent pickling process increases. For those reasons, a coiling temperature in a hot rolling process must be in the range from 500° C. to 800° C.

A finish rolling temperature and a coiling temperature of hot rolling can be measured with a radiation thermometer. It is preferable to calibrate a thermometer beforehand by measuring emissivity at different radiation temperatures. A correct emissivity value can be obtained by: attaching a thermocouple to the surface of a stainless steel sheet; heating the steel sheet and thereafter measuring the temperature change during cooling using the thermocouple and a radiation thermometer; and repeating the above procedures twice or more while adjusting the emissivity of the radiation thermometer.

In the final annealing process after cold rolling, it is necessary to heat a cold-rolled steel sheet to 800° C. to 950° C. for 0 to 30 sec. When a heating temperature in the final annealing process is lower than 800° C., un-recrystallized crystas may remain, crystal grains may be made fine, and thus the workability of a product steel sheet may deteriorate in some cases.

When a heating temperature in the final annealing process exceeds 950° C., on the other hand, crystal grains coarsen and a rough surface appears after forming. The effect of annealing shows up as long as an annealing temperature reaches a temperature in the above specified range even though a retention time at the annealing temperature is 0 sec. However, if a retention time exceeds 30 sec., crystal grains may coarsen in some cases. An annealing temperature and a retention time in the final annealing process can be adjusted by controlling the atmospheric temperature of an annealing furnace and a steel sheet traveling speed.

It is preferable to apply temper rolling after the final annealing from the viewpoint of eliminating yield elongation, correcting the shape of a steel sheet and so forth. A reduction ratio of less than 0.3% at temper rolling may be insufficient from the viewpoint of the elimination of yield elongation and the correction of a steel sheet shape, but, on the other hand, a reduction ratio exceeding 1.5% causes the hardening of a steel sheet and thus cracking occurs during forming and/or shape fixability deteriorates.

For the above reasons, it is preferable to regulate a reduction ratio at temper rolling in the range from 0.3 to 1.5%. The most suitable upper limit of a reduction ratio at temper rolling for obtaining good formability is less than 1.0%.

Note that a total reduction ratio at temper rolling is a value, expressed in terms of percentage, obtained by dividing the difference between the thickness of a cold-rolled steel sheet after finish cold rolling and the thickness of the cold-rolled steel sheet after temper rolling by the former thickness.

A solid lubricating film is applied to a cold-rolled steel sheet after subjected to temper rolling or not subjected to temper rolling. It is preferable to degrease the surface of a steel sheet before a solid lubricating film is applied. A preferable method of applying a solid lubricating film is to coat the solid lubricating film with brush coating, spray coating, roll coating, curtain coating or the like, dry the film, and then bake it at 70° C. to 200° C. for 0 to 1,800 sec.

In order to produce a steel sheet having a low tensile strength and a significantly improved shape fixability according to any one of the items (1) and (3) to (6), it is necessary to control the reduction ratios in hot rolling and cold rolling processes in respective appropriate ranges as specified in the production method according to the item (8) or (10).

When a total reduction ratio in a hot rolling process is less than 95%, a rolling texture may not develop and sufficient deep drawability and shape fixability may not be obtained in some cases. For this reason, the lower limit of a total reduction ratio in a hot rolling process must be 95% or more.

The higher the lower limit of a total reduction ratio in a hot rolling process, the better. A preferable total reduction ratio in a hot rolling process is 97% or more in consideration of the relationship between the thickness of a slab and a hot-rolled steel sheet and the most suitable total reduction ratio is 98% or more. No upper limit is specified for a total reduction ratio in a hot rolling process, but the maximum reduction ratio is about 99.8% in presently available technologies. Note that a total reduction ratio at hot rolling is a value, expressed in terms of percentage, obtained by dividing the difference between the thickness of a slab and the thickness of a hot-rolled steel sheet by the former thickness.

When a total reduction ratio at cold rolling is less than 60%, a rolling texture does not develop sufficiently and formability deteriorates as a result. When a total reduction ratio at cold rolling exceeds 95%, on the other hand, a rolling texture develops excessively and anisotropy increases as a result. For those reasons, a total reduction ratio at cold rolling must be in the range from 60 to 95%. A preferable range thereof is from 75 to 95%. Note that a total reduction ratio at cold rolling is a value, expressed in terms of percentage, obtained by dividing the difference between the thickness of a hot-rolled steel sheet and the thickness of a cold-rolled steel sheet after finish cold rolling by the former thickness.

In order to produce a steel sheet having the well-controlled state of precipitation and solid solution and a significantly improved deep drawability according to any one of the items (2) to (6), it is necessary to control a cooling rate in the final annealing process after a hot rolling or cold rolling process in an appropriate range as specified in the production method according to the item (9) or (10).

In the case of a steel sheet according to any one of the items (2) to (6), the cooling rate of a steel sheet in the final annealing process is of particular importance for changing the state of precipitation and solid solution and improving deep drawability.

That is to say, it is necessary to cool a steel sheet to a temperature of 500° C. or lower at a cooling rate of 10° C./sec. or more after heating. When a cooling rate is lower than 10° C./sec., workability may deteriorate in some cases. No upper limit is specified for a cooling rate, but 100° C./sec. is enough.

The reason why the temperature range wherein a cooling rate is specified is determined to be 500° C. or lower is that precipitation tends to occur in the temperature range from 500° C. to 950° C. No lower limit is particularly specified for a cooling end temperature, and a steel sheet may be cooled up to the room temperature at a cooling rate of 10° C./sec. or more. A cooling rate can be obtained by calculating a cooling time from a steel sheet traveling speed and the length a cooling zone and then dividing the difference between the temperatures of a steel sheet at the entry and the exit of the cooling zone by the resulting cooling time.

It is preferable to use an air blower or the like for the cooling of a steel sheet. When water is used for cooling, sufficient drying is required and, moreover, impurities contained in water may remain on a steel sheet surface and cause an uneven coating film in some cases.

By regulating the conditions of the production processes as mentioned above in addition to the aforementioned steel components, a ferritic stainless steel sheet excellent in press formability and operability wherein the r-value, the tensile strength and the state of precipitation and solid solution in the steel are controlled and a solid lubricating film is applied is obtained.

A steel sheet produced by the above production method is excellent in press formability and shape fixability, can be formed into complicated shapes, and can take the advantage of good appearance of a lubricating film. Therefore, a steel sheet according to the present invention is suitable as a material for members of electric appliances.

Concrete examples of applicable members are: outer panels and internal components of an electric keep-warm vessel, a microwave oven, a refrigerator, a washing machine, a dish washer and the like; and outer panels of a TV set, a videotape recorder and the like. When a ferritic stainless steel sheet according to the present invention is used for these applications, a preferable thickness range is from 0.4 to 1.5 mm.

EXAMPLE

Examples of the present invention are described below.

Example 1

The ferritic stainless steels shown in Table 1 were melted and steel sheets 0.5 to 0.6 mm in thickness were produced from them through the process combination of hot rolling, annealing of hot-rolled steel sheets (some hot-rolled steel sheets were excluded), cold rolling, and annealing. In the annealing of the hot-rolled steel sheets, the heating temperatures were 800° C. to 950° C. and the retention times were 0 to 30 sec. In the final annealing, the annealing temperatures were changed and the steel sheets were cooled by air with an air blower. In the final annealing, the retention times were 10 sec. and the cooling end temperatures were 500° C. or lower. All the steel sheets were subjected to temper rolling at the reduction ratio of 0.5% after the final annealing.

The heating temperatures (referred to as SRT), the finish rolling temperatures (referred to as FT), the coiling temperatures (referred to as CT) and the total reduction ratios at the hot rolling, the total reduction ratios at the cold rolling, and the annealing temperatures at the final annealing are shown in Table 2. SUS304 steel sheets were also prepared as comparative steel sheets.

The r-value and the tensile strength of each of the steel sheets thus produced were measured in the longitudinal, thickness and width directions and the average values were calculated respectively. An r-value was measured in conformity with JIS Z 2254 and a tensile strength was measured in conformity with JIS Z 2241.

The solid lubricating films of acrylic, acrylic-urethane, epoxy, epoxy-urethane, urethane-polyethylene and urethane systems were applied to the steel sheets with a roll coater, dried and then baked at the temperatures of 70° C. to 200° C. for 0 to 1,800 sec.

The friction coefficients of the steel sheets after applying the solid lubricating films and the friction coefficient of the reference material having a surface roughness Ra of 0.06 μm and being not coated with a solid lubricating film were measured by Bowden test without applying lubricating oil, and the ratios Z of the friction coefficients of the steel sheets with the solid lubricating films to the friction coefficient of the reference material were calculated.

Formability was measured by the TZP test and the rectangular cup forming test, and the LDRs and the rectangular cup drawing depths were used respectively as the indicators of formability. The TZP test was carried out using the blanks 90 to 120 mm in diameter and a punch 50 mm in diameter. The rectangular cup forming test was carried out using a rectangular cylindrical punch and a rectangular die, and the formability was evaluated by the drawing depth at the time when a specimen cracked.

Shape fixability was evaluated by hat-shape bending test, wherein the angle of the portion of a specimen bent by the shoulder of a punch was measured and the shape fixability was evaluated by the splay angle defined by the deviation of the measured angle from a right angle.

The production conditions, the r-values, the tensile strengths, the ratios Z, the LDRs, the rectangular cup drawing depths and the splay angles of the steel sheets are shown also in Table 2.

The steel sheets according to the present invention showed formability equal to or better than that of the SUS304 steel sheet. On the other hand, in the cases of the steel sheet A produced at the total hot rolling reduction ratio of 85% and the steel sheet E produced at the total hot rolling reduction ratio of 94%, those total hot rolling reduction ratios being lower than those in the range specified in the present invention, and the steel sheets B and C produced at the total cold rolling reduction ratio of 50%, the total cold rolling reduction ratio being lower than that in the range specified in the present invention, the r-values were lower than those in the range specified in the present invention, the LDRs and the rectangular cup drawing depths decreased and the splaying angles increased.

Further, in the cases of the steel sheets A, D and E produced at the final annealing temperature of 750° C. which was lower than a temperature in the range specified in the present invention, the recrystallization was insufficient, the tensile strength was high, and, as a result, the rectangular cup drawing depths decreased, and the splaying angles increased and thus the shape fixability deteriorated.

Furthermore, in the cases of the steel sheets B and D having the ratios Z equal to 0.7, as the properties of the solid lubricating films were insufficient, the rectangular cup drawing depths decreased. In the case of the steel sheet F, as the amounts of P and Ti exceeded the amounts in the respective ranges specified in the present invention, the tensile strength was high and the rectangular cup drawing depth and the shape fixability decreased.

TABLE 1

| Steel | Chemical components (in mass %) | | | | | | | | | | | |
|---|---|---|---|---|---|---|---|---|---|---|---|---|
| symbol | C | Si | Mn | P | S | Al | Cr | N | Ti | V | Others | Remarks |
| A | 0.0082 | 0.55 | 0.35 | 0.018 | 0.002 | 0.035 | 11.2 | 0.008 | 0.21 | 0.06 | | Invention sample |
| B | 0.0044 | 0.15 | 0.15 | 0.011 | 0.003 | 0.021 | 17.2 | 0.002 | 0.15 | 0.10 | 1.3 Mo | Invention sample |

TABLE 1-continued

| Steel symbol | Chemical components (in mass %) C | Si | Mn | P | S | Al | Cr | N | Ti | V | Others | Remarks |
|---|---|---|---|---|---|---|---|---|---|---|---|---|
| C | 0.0021 | 0.06 | 0.11 | 0.014 | 0.004 | 0.008 | 16.3 | 0.010 | 0.16 | 0.08 | 0.0008 Mg, 0.0007 B | Invention sample |
| D | 0.0040 | 0.21 | 0.08 | 0.012 | 0.008 | 0.042 | 18.5 | 0.009 | 0.12 | 0.11 | 0.0022 Mg | Invention sample |
| E | 0.0011 | 0.05 | 0.12 | 0.011 | 0.003 | 0.011 | 14.6 | 0.007 | 0.12 | 0.09 | 0.5 Mo | Invention sample |
| F | 0.0015 | 0.05 | 0.12 | 0.025 | 0.003 | 0.011 | 17.0 | 0.006 | 0.31 | 0.09 | 0.5 Mo | Comparative sample |
| SUS304 | 0.0400 | 0.50 | 0.80 | 0.030 | 0.001 | 0.005 | 18.0 | 0.040 | — | — | 8.0 Ni | Comparative sample |

Underlined figures are outside the relevant ranges specified in the present invention.

TABLE 2

| Steel symbol | Hot rolling SRT ° C. | FT ° C. | CT ° C. | Total reduction ratio % | Annealing of hot-rolled sheet | Cold rolling Total reduction ratio % | Final annealing Annealing temperature ° C. | r-value | Tensile strength MPa |
|---|---|---|---|---|---|---|---|---|---|
| A | 1160 | 880 | 620 | 98 | Not applied | 80 | 750 | 1.6 | 472 |
| | | 870 | 600 | 98.1 | Not applied | 70 | 840 | 2.0 | 420 |
| | | | | | Applied | 80 | 840 | 2.0 | 410 |
| | | 890 | 650 | 85 | Applied | 65 | 860 | 1.6 | 431 |
| B | 1150 | 850 | 580 | 98 | Not applied | 50 | 900 | 1.4 | 410 |
| | | | | | Not applied | 70 | 880 | 2 | 420 |
| | | | | | Applied | 80 | 885 | 2.2 | 405 |
| | | | | | Applied | 85 | 920 | 2.1 | 415 |
| C | 1150 | 790 | 750 | 98.1 | Not applied | 50 | 875 | 1.5 | 361 |
| | | | | | Not applied | 90 | 900 | 2.4 | 378 |
| | | | | | Applied | 80 | 850 | 2.3 | 380 |
| D | 1180 | 780 | 640 | 98.2 | Applied | 85 | 900 | 2.2 | 415 |
| | | | | | Not applied | 93 | 750 | 1.8 | 530 |
| | | | | | Not applied | 83 | 900 | 2.2 | 420 |
| | | | | | Applied | 80 | 880 | 2 | 410 |
| E | 1150 | 820 | 640 | 98 | Applied | 81 | 900 | 2.3 | 415 |
| | | | | | Not applied | 80 | 750 | 1.8 | 460 |
| | | | | | Not applied | 80 | 890 | 1.9 | 410 |
| | | 800 | 610 | 94 | Applied | 80 | 875 | 1.6 | 410 |
| F | 1150 | 820 | 640 | 98.2 | Applied | 80 | 900 | 2.3 | 465 |
| | | 810 | 620 | 98 | Not applied | 80 | 890 | 2.1 | 475 |
| SUS304 | 1250 | 900 | 620 | 98.5 | Applied | 70 | 1050 | 0.9 | 595 |

| Steel symbol | Formability Z | LDR | Rectangular cup drawing depth mm | Splaying angle ° | Remarks |
|---|---|---|---|---|---|
| A | 0.3 | 1.9 | 48 | 4 | Comparative sample |
| | 0.35 | 2.1 | 65 | 1 | Invention sample |
| | 0.25 | 2.1 | 65 | 1 | Invention sample |
| | 0.3 | 1.8 | 48 | 3 | Comparative sample |
| B | 0.3 | 1.7 | 59 | 3 | Comparative sampl |

TABLE 2-continued

| | | | | | |
|---|---|---|---|---|---|
| | 0.31 | 2.4 | 62 | 1 | Invention sample |
| | 0.28 | 2.4 | 63 | 1 | Invention sample |
| | 0.7 | 1.8 | 58 | 1 | Comparative sample |
| C | 0.3 | 1.7 | 59 | 3 | Comparativ sample |
| | 0.29 | 2.7 | 64 | 1 | Invention sample |
| | 0.33 | 2.4 | 63 | 1 | Invention sample |
| D | 0.7 | 1.9 | 51 | 1 | Comparative sample |
| | 0.31 | 1.9 | 45 | 5 | Comparative sample |
| | 0.32 | 2.3 | 61 | 1 | Invention sample |
| | 0.22 | 2.4 | 63 | 1 | Invention sample |
| E | 0.19 | 2 | 63 | 1 | Invention sample |
| | 0.28 | 1.8 | 50 | 3 | Comparative sample |
| | 0.3 | 2.1 | 61 | 1 | Invention sample |
| | 0.31 | 1.9 | 60 | 2 | Comparative sample |
| F | 0.3 | 2 | 57 | 3 | Comparative sample |
| | 0.3 | 1.8 | 52 | 4 | Comparative sample |
| SUS304 | 0.3 | 2 | 60 | 4 | Comparative sample |

Underlined figures are outside the relevant ranges specified in the present invention.

Example 2

The ferritic stainless steel sheets 0.5 to 0.6 mm in thickness were produced in the same manner as in Example 1 except that the annealing temperatures of the final annealing were changed and the cooling rates at the cooling of the steel sheets were also changed by changing the air flow amounts of an air blower used for the air cooling of the steel sheets.

The retention times of the annealing were 10 sec. and the cooling end temperatures were 500° C. or lower. The SRTS, the FTs, the CTs, the total reduction ratios at the hot rolling, the total reduction ratios at the cold rolling, the annealing temperatures and cooling rates at the final annealing are shown in Table 3. SUS304 steel sheets were also prepared as comparative steel sheets.

The average r-values of the steel sheets thus produced were measured also in the same manner as in Example 1. The electrolytically extracted residues of the steel sheets were analyzed quantitatively and the amounts of Sol-Ti and Insol-V were obtained from the analysis results of respective components. The same solid lubricating films as used in Example 1 were applied to the surfaces of the steel sheets and the ratios Z were determined through Bowden test. Thereafter, the LDRs and the rectangular cup drawing depths were also evaluated.

The r-values, the amounts of Sol-Ti and Insol-V, the ratios Z, the LDRs and the rectangular cup drawing depths are shown also in Table 3.

The steel sheets according to the present invention showed formability equal to or better than that of the SUS304 steel sheet. On the other hand, in the case of the steel sheet A produced at the final annealing temperature of 1,050° C. which was higher than a temperature in the range specified in the present invention, the amount of Sol-Ti was larger than that in the range specified in the present invention, the crystal grains coarsened, and, as a result, the LDR and the rectangular cup drawing depth decreased.

Further, in the case of the steel sheet B produced at the final annealing temperature of 780° C. which was lower than a temperature in the range specified in the present invention, the recrystallization was insufficient, and, as a result, the LDR and the rectangular cup drawing depth decreased.

Furthermore, in the cases of the steel sheets A, B and E produced at the final annealing cooling rate of 5° C./sec. which was lower than a cooling rate in the range specified in the present invention and the steel sheet C produced at the final annealing cooling rate of 2° C./sec. which was also lower than a cooling rate in the range specified in the present invention, the amounts of Insol-V were larger than an amount in the range specified in the present invention, and, as a result, the rectangular cup drawing depths decreased.

Still further, in the case of the steel sheet D having the ratio Z equal to 0.68, the properties of the solid lubricating film were insufficient and, as a consequence, the rectangular cup drawing depth decreased.

Still further, in the case of the steel sheet F, since the amounts of P and Ti exceeded the amounts in the respective ranges specified in the present invention, the amount of Sol-Ti was larger than an amount in the range specified in the present invention and the rectangular cup drawing depth decreased.

TABLE 3

| Steel symbol | Hot rolling SRT ° C. | FT ° C. | CT ° C. | Total reduction ratio % | Annealing of hot-rolled sheet | Cold rolling Total reduction ratio % | Final annealing Annealing temperature ° C. | Cooling rate ° C./sec. |
|---|---|---|---|---|---|---|---|---|
| A | 1160 | 870 | 600 | 98.1 | Not applied | 70 | 840 | 15 |
| | | | | | Not applied | 70 | 875 | 5 |
| | | 800 | 620 | 98 | Applied | 80 | 880 | 15 |
| | | | | | Applied | 80 | 1050 | 15 |
| B | 1150 | 850 | 580 | 98 | Not applied | 70 | 880 | 20 |
| | | | | | Not applied | 75 | 875 | 5 |
| | | | | | Applied | 81 | 860 | 15 |
| | | | | | Applied | 85 | 780 | 18 |
| C | 1150 | 790 | 750 | 98.1 | Not applied | 90 | 877 | 20 |
| | | | | | Applied | 90 | 900 | 2 |
| | | | | | Applied | 90 | 875 | 30 |
| D | 1180 | 780 | 650 | 98.2 | Not applied | 83 | 860 | 15 |
| | | | | | Not applied | 80 | 875 | 15 |
| | | | | | Applied | 70 | 880 | 40 |
| E | 1150 | 820 | 640 | 98 | Not applied | 80 | 875 | 20 |
| | | | | | Not applied | 85 | 895 | 5 |
| | | | | | Applied | 80 | 890 | 30 |
| F | 1150 | 820 | 640 | 98.2 | Applied | 80 | 900 | 15 |
| | | 810 | 620 | 98 | Not applied | 80 | 890 | 15 |
| SUS304 | 1250 | 900 | 620 | 98.5 | Applied | 70 | 1050 | |

| Steel symbol | Sol-Ti mass % | Insol-V mass % | Z | Formability LDR | Rectangular cup drawing depth mm | Remarks |
|---|---|---|---|---|---|---|
| A | 0.15 | <0.01 | 0.35 | 2.1 | 65 | Invention sample |
| | 0.15 | 0.02 | 0.29 | 1.9 | 65 | Comparative sample |
| | 0.15 | <0.01 | 0.31 | 2.1 | 65 | Invention sample |
| | 0.18 | <0.01 | 0.35 | 1.9 | 59 | Comparative sample |
| B | 0.13 | <0.01 | 0.29 | 2.4 | 62 | Invention sample |
| | 0.12 | 0.02 | 0.31 | 2.1 | 59 | Comparative sample |
| | 0.13 | <0.01 | 0.31 | 2.4 | 62 | Invention sample |
| | 0.12 | <0.01 | 0.31 | 1.9 | 45 | Comparative sample |
| C | 0.12 | <0.01 | 0.29 | 2.7 | 64 | Invention sample |
| | 0.11 | 0.02 | 0.29 | 1.9 | 58 | Comparative sample |
| | 0.12 | <0.01 | 0.31 | 2.8 | 64 | Invention sample |
| D | 0.07 | <0.01 | 0.32 | 2.3 | 61 | Invention sample |
| | 0.06 | <0.01 | 0.25 | 2.4 | 61 | Invention sample |
| | 0.08 | <0.01 | 0.68 | 1.9 | 58 | Comparative sample |
| E | 0.10 | <0.01 | 0.3 | 2.1 | 61 | Invention sample |
| | 0.09 | 0.02 | 0.29 | 1.9 | 59 | Comparative sample |
| | 0.10 | <0.01 | 0.22 | 2.3 | 63 | Invention sample |

TABLE 3-continued

| | | | | | | |
|---|---|---|---|---|---|---|
| F | 0.24 | <0.01 | 0.3 | 2 | 53 | Comparative sample |
| | 0.25 | <0.01 | 0.31 | 1.8 | 52 | Comparative sample |
| SUS304 | — | — | 0.3 | 2 | 60 | Comparative sample |

Underlined figures are outside the relevant ranges specified in the present invention.

Example 3

The ferritic stainless steel sheets 0.5 to 0.6 mm in thickness were produced in the same manner as in Example 1 except that the annealing temperatures of the final annealing were changed and the cooling rates at the cooling of the steel sheets were also changed by changing the air flow amounts of an air blower used for the air cooling of the steel sheets.

The retention times of the annealing were 10 sec. and the cooling end temperatures were 500° C. or lower. The SRTS, the FTs, the CTs, the total reduction ratios at the hot rolling, the total reduction ratios at the cold rolling, the annealing temperatures and cooling rates at the final annealing are shown in Table 4. SUS304 steel sheets were also prepared as comparative steel sheets.

The r-values and the tensile strengths of the steel sheets thus produced were measured also in the same manner as in Example 1 and the amounts of Sol-Ti and Insol-V were obtained in the same manner as in Example 2. The same solid lubricating films as used in Examples 1 and 2 were applied to the surfaces of the steel sheets, the ratios Z were determined through Bowden test, and the formability tests were carried out. The r-values, the amounts of Sol-Ti and Insol-V, the ratios Z, the LDRs, the rectangular cup drawing depths and the splaying angles are shown also in Table 4.

The steel sheets according to the present invention showed formability equal to or better than that of the SUS304 steel sheet. On the other hand, in the case of the steel sheet A produced at the final annealing temperature of 1,050° C. which was higher than a temperature in the range specified in the present invention, the amount of Sol-Ti was larger than an amount in the range specified in the present invention, the crystal grains coarsened, and, as a result, the LDR and the rectangular cup drawing depth decreased.

Further, in the case of the steel sheet B produced at the final annealing temperature of 780° C. which was lower than a temperature in the range specified in the present invention, the recrystallization was insufficient, the tensile strength was high and, as a result, the rectangular cup drawing depth decreased, and the splay angle increased and thus shape fixability deteriorated.

Furthermore, in the cases of the steel sheets A, B and E produced at the final annealing cooling rate of 5° C./sec. which was lower than a cooling rate in the range specified in the present invention and the steel sheet C produced at the final annealing cooling rate of 2° C./sec. which was also lower than a cooling rate in the range specified in the present invention, the amounts of Insol-V were larger than an amount in the range specified in the present invention, and, as a result, the LDRs and the rectangular cup drawing depths decreased.

Still further, in the case of the steel sheet D having the ratio Z equal to 0.68, the properties of the solid lubricating film were insufficient and, as a consequence, the rectangular cup drawing depth decreased. In the case of the steel sheet F, as the amounts of P and Ti exceeded the amounts in the respective ranges specified in the present invention, the tensile strength was high and the rectangular cup drawing depth and the shape fixability decreased.

TABLE 4

| | Hot rolling | | | | Annealing | Cold rolling | Final annealing | | | |
|---|---|---|---|---|---|---|---|---|---|---|
| Steel symbol | SRT ° C. | FT ° C. | CT ° C. | Total reduction ratio % | of hot-rolled sheet | Total reduction ratio % | Annealing temperature ° C. | Cooling rate ° C./sec. | r-value | Tensile strength MPa |
| A | 1160 | 870 | 600 | 98 | Not applied | 72 | 845 | 20 | 1.9 | 410 |
| | | | | | Not applied | 72 | 880 | 5 | 1.9 | 409 |
| | | 880 | 620 | 98.1 | Applied | 85 | 885 | 18 | 1.9 | 400 |
| | | | | | Applied | 85 | 1050 | 17 | 1.9 | 395 |
| B | 1150 | 850 | 580 | 98.1 | Not applied | 75 | 875 | 19 | 2 | 410 |
| | | | | | Not applied | 80 | 870 | 5 | 2 | 402 |
| | | | | | Applied | 80 | 850 | 16 | 2.2 | 421 |
| | | | | | Applied | 85 | 780 | 20 | 2 | 451 |
| C | 1150 | 790 | 750 | 98 | Not applied | 85 | 880 | 18 | 2.4 | 381 |
| | | | | | Applied | 85 | 890 | 2 | 2 | 391 |
| | | | | | Applied | 85 | 870 | 20 | 2.4 | 368 |
| D | 1180 | 780 | 640 | 98 | Not applied | 85 | 850 | 16 | 2.2 | 410 |
| | | | | | Not applied | 90 | 880 | 18 | 2.2 | 442 |

TABLE 4-continued

| | | | | | | | | | | |
|---|---|---|---|---|---|---|---|---|---|---|
| | | | | | Applied | 75 | 885 | 30 | 2.2 | 406 |
| E | 1150 | 820 | 640 | 98.1 | Not applied | 85 | 880 | 15 | 1.9 | 405 |
| | | | | | Not applied | 88 | 900 | 5 | 1.9 | 420 |
| | | | | | Applied | 72 | 895 | 25 | 2.1 | 433 |
| F | 1150 | 820 | 640 | 98.1 | Applied | 72 | 890 | 20 | 2.3 | 480 |
| | | 810 | 620 | 98 | Not applied | 72 | 880 | 18 | 2.1 | 470 |
| SUS304 | 1250 | 900 | 620 | 98.2 | Applied | 80 | 1050 | | 0.9 | 610 |

| | | | | Formability | | | |
|---|---|---|---|---|---|---|---|
| Steel symbol | Sol-Ti mass % | Insol-V mass % | Z | LDR | Rectangular cup drawing depth mm | Splaying angle ° | Remarks |
| A | 0.15 | <0.01 | 0.35 | 2.1 | 65 | 1 | Invention sample |
| | 0.14 | 0.02 | 0.29 | 1.7 | 58 | 1 | Comparative sample |
| | 0.15 | <0.01 | 0.31 | 2.1 | 65 | 1 | Invention sample |
| | 0.19 | <0.01 | 0.35 | 1.9 | 59 | 1 | Comparative sample |
| B | 0.12 | <0.01 | 0.29 | 2.4 | 62 | 1 | Invention sample |
| | 0.13 | 0.02 | 0.31 | 1.9 | 59 | 1 | Comparative sample |
| | 0.12 | <0.01 | 0.31 | 2.4 | 62 | 1 | Invention sample |
| | 0.12 | <0.01 | 0.31 | 2 | 45 | 3 | Comparative sample |
| C | 0.11 | <0.01 | 0.29 | 2.7 | 64 | 1 | Invention sample |
| | 0.13 | 0.02 | 0.29 | 1.9 | 58 | 1 | Comparative sample |
| | 0.11 | <0.01 | 0.31 | 2.7 | 64 | 1 | Invention sample |
| D | 0.07 | <0.01 | 0.32 | 2.3 | 61 | 1 | Invention sample |
| | 0.06 | <0.01 | 0.31 | 2.3 | 61 | 1 | Invention sample |
| | 0.08 | <0.01 | 0.61 | 1.9 | 58 | 1 | Comparative sample |
| E | 0.09 | <0.01 | 0.3 | 2.1 | 61 | 1 | Invention sample |
| | 0.12 | 0.02 | 0.29 | 1.9 | 59 | 1 | Comparative sample |
| | 0.09 | <0.01 | 0.22 | 2.3 | 63 | 1 | Invention sample |
| F | 0.29 | <0.01 | 0.3 | 2 | 54 | 4 | Comparative sample |
| | 0.29 | <0.01 | 0.31 | 1.8 | 53 | 3 | Comparative sample |
| SUS304 | — | — | 0.3 | 2 | 60 | 4 | Comparative sample |

Underlined figures are outside the relevant ranges specified in the present invention.

INDUSTRIAL APPLICABILITY

The present invention makes it possible to provide a ferritic stainless steel sheet excellent in press formability and operability and a method for producing the steel sheet, and thus to contribute to expanding the range of the use of ferritic stainless steel.

Therefore, the industrial significance of the present invention is extremely large.

The invention claimed is:

1. A ferritic stainless steel sheet excellent in press formability and operability, characterized by: containing, in mass, C: 0.001 to 0.01%, N: 0.001 to 0.015%, Cr: 10 to 19%, Si: 0.01 to 0.8%, Mn: 0.01 to 0.5%, P: 0.01 to 0.02%, S: less than 0.01%, Al: 0.005 to 0.1%, Ti: 0.05 to 0.25%, and V: 0.03 to 0.12%, with the balance consisting of Fe and unavoidable impurities; having a solid lubricating film or films on one or both of the surfaces; and having a ratio Z, defined as $Z=Z_1/Z_2$, of less than 0.5, a tensile strength of 450 MPa or less and an average r-value of 1.7 or more, wherein $Z_1$ is a friction coefficient of the surface of a solid lubricating film and $Z_2$ that of the surface of a reference material having a surface roughness Ra in the range from 0.05 to 0.07 μm and being coated with neither a coating nor lubricating oil.

2. A ferritic stainless steel sheet excellent in press formability and operability, characterized by: containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
Sol-Ti: 0.03 to 0.16%,
V: 0.03 to 0.12%, and
Insol-V: less than 0.01%, with the balance consisting of Fe and unavoidable impurities, wherein Sol-Ti means the amount of Ti existing in the state of solid solution in steel and Insol-V means the amount of V existing in the state of precipitation in steel; having a solid lubricating film or films on one or both of the surfaces; and having a ratio Z, defined as $Z=Z_1/Z_2$, of less than 0.5, a tensile strength of 450 MPa or less and an average r-value of 1.7 or more, wherein $Z_1$ is a friction coefficient of the surface of a solid lubricating film and $Z_2$ that of the surface of a reference material having a surface roughness Ra in the range from 0.05 to 0.07 μm and being coated with neither a coating nor lubricating oil.

3. A ferritic stainless steel sheet excellent in press formability and operability, characterized by: containing, in mass, C: 0.001 to 0.01%,
N: 0.001 to 0.015%,
Cr: 10 to 19%,
Si: 0.01 to 0.8%,
Mn: 0.01 to 0.5%,
P: 0.01 to 0.02%,
S: less than 0.01%,
Al: 0.005 to 0.1%,
Ti: 0.05 to 0.25%,
Sol-Ti: 0.03 to 0.16%,
V: 0.03 to 0.12%, and
Insol-V: less than 0.01%, with the balance consisting of Fe and unavoidable impurities, wherein Sol-Ti means the amount of Ti existing in the state of solid solution in steel and Insol-V means the amount of V existing in the state of precipitation in steel; having a solid lubricating film or films on one or both of the surfaces; and having a ratio Z, defined as $Z=Z_1/Z_2$, of less than 0.5, wherein $Z_1$ is a friction coefficient of the surface of a solid lubricating film and $Z_2$ that of the surface of a reference material having a surface roughness Ra in the range from 0.05 to 0.07 μm and being coated with neither a coating nor lubricating oil.

4. A ferritic stainless steel sheet excellent in press formability and operability according to claim 1, characterized by containing, in mass, 0.0001 to 0.01% Mg.

5. A ferritic stainless steel sheet excellent in press formability and operability according to claim 1, characterized by containing, in mass, 0.0005 to 0.005% B.

6. A ferritic stainless steel sheet excellent in press formability and operability according to claim 1, characterized by containing, in mass, 0.1 to 3% Mo.

7. A member of an electric appliance characterized by being made of a ferritic stainless steel sheet excellent in press formability and operability according to claim 1.

* * * * *